United States Patent [19]

Brierley et al.

[11] 4,397,755

[45] Aug. 9, 1983

[54] STABLE LIQUID DETERGENT SUSPENSIONS

[75] Inventors: John M. Brierley, Little Neston; Melvin Scott, Great Sutton, both of England

[73] Assignee: Lever Brothers Company, New York, N.Y.

[21] Appl. No.: 311,498

[22] Filed: Oct. 15, 1981

[30] Foreign Application Priority Data

Oct. 16, 1980 [GB] United Kingdom ..... 8033467

[51] Int. Cl.[3] ..... C11D 1/83; C11D 3/14; C11D 9/20; C11D 17/08

[52] U.S. Cl. ..... 252/113; 252/120; 252/121; 252/128; 252/131; 252/140; 252/155; 252/173; 252/174.21; 252/174.25; 252/DIG. 14

[58] Field of Search ..... 252/112, 113, 115, 116, 252/119, 120, 123, 124, 128, 131, 140, 154, 155, 173, 174.25, DIG. 14, 174.2

[56] References Cited

U.S. PATENT DOCUMENTS

| | | | |
|---|---|---|---|
| 3,522,186 | 7/1970 | Cambre | 252/112 |
| 3,884,826 | 5/1975 | Phares | 252/106 |
| 3,985,668 | 10/1976 | Hartman | 252/99 |
| 4,005,027 | 1/1977 | Hartman | 252/95 |
| 4,116,849 | 9/1978 | Leikhim | 252/103 |
| 4,248,728 | 2/1981 | Puryear | 252/103 |
| 4,302,347 | 11/1981 | Straw | 252/116 |

*Primary Examiner*—Dennis L. Albrecht

*Attorney, Agent, or Firm*—Milton L. Honig; James J. Farrell

[57] ABSTRACT

The invention pertains to liquid media, in which particulate materials can be stably suspended, e.g. liquid abrasive cleaning compositions.

These products can suffer from a shear-stability problem, and according to the invention this problem can be overcome by the inclusion of a low level, e.g. 0.001–0.2% of a hectorite clay.

6 Claims, No Drawings

STABLE LIQUID DETERGENT SUSPENSIONS

The present invention relates to stable liquid detergent compositions comprising a liquid medium capable of stably suspending non-colloidal undissolved particulate material therein.

Liquid detergent compositions, aqueous as well as non-aqueous, containing a liquid medium in which undissolved particulate material is suspended, are well-known in the art. Typical examples thereof are built liquid detergent compositions which contain either soluble inorganic and/or organic builders at a level above their solubility in the liquid medium, the undissolved part of these builders being suspended in that medium, or insoluble builder materials which are suspended as a whole in the liquid medium. Typical examples of these types of builders are the polyphosphate builders and the zeolites.

Other typical liquid detergent compositions comprising an undissolved particulate material suspended in a liquid medium are those which contain an insoluble particulate abrasive material suspended therein. Such compositions are more commonly known as liquid abrasive cleaning compositions. Typical examples of abrasive particulate materials suspended in such liquid compositions are calcite, silica, felspar, pumice and the like.

Often during the manufacture of such liquid detergent compositions containing undissolved particulate material suspended in a liquid medium, these compositions can undergo high extensional flows. High extensional shear rates can occur in valves, filters, pumps and pipe bends used in the course of the manufacture of such liquids. We have found that high extensional shear rates may cause a breakdown of the suspension, whereby phase separation and deposition of the undissolved particulate material can occur. Such a breakdown is associated with a reduced viscosity. We have found that this breakdown occurs particularly at high extensional shear rates, e.g. at rates of 20,000 $sec^{-1}$ and higher in the case of several liquid abrasive cleaning compositions. Naturally, the shear rate at which such a breakdown may occur is dependent upon the qualitative and quantitative composition of the suspension, and can be easily determined by the reduction in viscosity and change in appearance of the suspension when subjected to high extensional shear rates.

According to the present invention we have found that liquid compositions of the above type can be stabilized to a significant extent against breakdown at high extensional shear rates by inclusion in the liquid suspending medium of an effective, low level of a hectorite clay.

It has already been proposed in U.K. Pat. No. 1,471,278 to include from 0,25 to 1% by weight of a suspending agent in a liquid abrasive cleaning composition to suspend the insoluble abrasive material therein. This suspending agent includes natural and synthetic clays of the hectorite type.

The liquid medium of this prior proposal in which the insoluble particulate material is to be suspended has no satisfactory suspending property of its own; hence this prior proposal requires the particular suspending agent to suspend the insoluble particulate material in that liquid medium.

In contrast thereto the liquid medium of our compositions has, by itself, already a satisfactory suspending capacity.

Consequently, according to our invention an improved stable, liquid detergent composition is obtained comprising a liquid medium, capable of stably suspending non-colloidal particulate material, in which an effective, low level of a hectorite clay is included.

We have found that the inclusion in our compositions of 0.001–0.2%, preferably 0.01–0.2% by weight of a hectorite clay stabilizes our compositions against breakdown of the suspension under high extensional shear rates.

The hectorite clay can be a natural or a synthetic hectorite clay. If a natural hectorite clay is used, it is preferably a purified hectorite such as Macaloid R, ex National Lead Co. A typical analysis of Macaloid on a dry basis is 51.89% $SiO_2$, 22.07% MgO, 1.21% $Li_2O$, 3.08% $Na_2O$, 6.46% CaO, 0.32% $Fe_2O_3$, 0.77% $Al_2O_3$ and 2.07% F. Particularly preferred, however, are the synthetic hectorite clays, such as those available under the Registered Trade Mark "Laponite" of Laporte Industries Ltd. Suitable grades of Laponite are Laponite S, Laponite XLS, Laponite RD, and we particularly prefer Laponite RDS. This is a synthetic hectorite, having a physical form of platelets, and having the following typical data: 61.3% $SiO_2$, 27.9% MgO, 3.2% $Na_2O$, 1.0% $Li_2O$, 6% phosphate (added as $Na_4P_2O_7$) and 8% $H_2O$ (measured as water loss at 105° C.).

The liquid media of our compositions, in which the undissolved particulate materials are suspended, are liquid media which have clear suspending properties of their own, i.e. without the hectorite clay included. Such media comprise aqueous suspending media, in which an anionic detergent material is present. A nonionic detergent is preferably also present in the aqueous media. For liquid abrasive cleaning compositions such systems have e.g. been described in U.K. Pat. Nos. 882,569 and 955,081, and for built liquid detergent compositions such systems have e.g. been described in U.K. Pat. No. 1,506,427 and SA Pat. No. 77/3065.

It is to be noted, however, that the present invention is not limited to compositions according to these references; the invention is also applicable to other liquid detergent compositions which contain undissolved particulate material suspended in a liquid medium, the liquid medium already having a satisfactory suspending property of its own.

Typical examples of suspending liquid media comprise an anionic detergent such as alkali metal or alkanolamine salts of $C_{12}$–$C_{18}$ branched- or straight-chain alkylaryl sulphonates, of $C_{12}$–$C_{18}$ paraffin sulphonate, of $C_{10}$–$C_{18}$ alkyl sulphates, of $C_{10}$–$C_{18}$ alkyl $(EO)_{1-10}$ sulphates, of $C_{10}$–$C_{24}$ fatty acid soaps etc. Other anionic detergents as well as mixtures of different anionic detergents are also suitable. The amounts to be used may vary widely, dependent upon the type and purpose of the liquid composition. In general, the amount will vary between 0.5 and 20%, usually between 1.5 and 18% and preferably between 3 and 15% by weight of the final composition.

The suspending liquid media usually comprise a water-soluble electrolyte, such as sodium carbonate, sodium bicarbonate, borax, sodium sulphate, sodium orthophosphate, alkali metal pyro-, -tripoly- and polymetaphosphates, sodium nitrilotriacetate, sodium citrate, sodium carboxymethyloxysuccinate, and so on. Several of these electrolytes are builders, and organic and/or inorganic builders can also be included in the composition of the invention.

If the media comprise a water-soluble electrolyte, the amount of electrolyte should be at least 0.5%, the maximum amount depending upon the type of electrolyte used. Thus, for the phosphates, used as builder for instance, up to 25% can be included. In liquid abrasive cleaning compositions the amount of electrolyte can be up to 15%, usually up to 10% by weight. It is often advantageous, as stated before, to include also a nonionic detergent in the liqui ! suspending medium in an amount of 0.5–15, preferably 2–12% by weight.

Suitable examples of nonionic detergents are water-soluble condensation products of ethylene- and/or propylene oxide with linear primary or secondary $C_{10}$–$C_{18}$ alcohols with $C_{10}$–$C_{18}$ fatty acid amides or fatty acid alkylolamides with $C_9$–$C_{18}$ alkyl-phenols and so on. $C_{10}$–$C_{18}$ fatty acid alkylolamides are also suitable as the nonionic detergents and are especially preferred. Further suitable examples of nonionic detergents are amply described in the textbook "Nonionic Surfactants" by M. Schick.

The undissolved particulate materials are those which are partly or completely insoluble in the liquid suspending media, such as particulate abrasive materials, insoluble builders such as zeolites, and high levels (i.e. above their solubility) of inorganic or organic buildersalts. Preferably the material is an abrasive material, such as calcite. The insoluble particulate material should be non-colloidal, and usually has a mean particle size of up to 150 micron, in most cases up to 100 micron. The amount of particulate abrasive material in the final composition ranges from 0.2–70%, usually 1–60% and preferably from 5–55% by weight.

The compositions may furthermore comprise other ingredients useful in liquid detergent compositions, such as perfumes, colouring agents, fluorescers, hydrotropes, soil-suspending agents, oxygen and chlorine-liberating bleaching agents, bleach precursors, enzymes, opacifiers, germicides, humectants, etc. Thus, for example, where the invention is applied to liquid abrasive cleaning compositions, these may usefully further comprise the usual perfumes, ammonia and the like.

The invention will further be illustrated by the following Examples.

EXAMPLES 1–4

The following liquid abrasive cleaning compositions were prepared:

| | % by weight | | | |
|---|---|---|---|---|
| | 1 | 2 | 3 | 4 |
| sodium $C_{12}$—alkylbenzene sulphonate | 1.65 | 1.65 | 2.75. | 2.75 |
| potassium groundnut oil soap | 1.10 | 1.10 | 0.55 | 0.55 |
| coconut fatty acid diethanol amide | 2.75 | 2.75 | 2.20 | 2.20 |
| sodium tripolyphosphate | 5.5 | 5.5 | 5.5 | 5.5 |
| calcite | 45 | 45 | 45 | 45 |
| ammonia | 0.04 | 0.04 | 0.04 | 0.04 |
| water, perfume etc. | | balance | | |

Formulations 1 and 3 were used as a control in a comparison with the same formulations 2 and 4, which also contained 0.2% and 0.01 wt.%, respectively, of Laponite RDS. The formulations were tested unsheared, as well as after 2 passes through an orifice at an extensional shear rate of 37,000 $sec^{-1}$. The testing involved measurement of the viscosity (in cP at 21 $sec^{-1}$) and the storage stability (at ambient temperature after 2 days).

The following Table represents the results:

| Shearing condition | Viscosity of Example | | | | Stability of Example | | | |
|---|---|---|---|---|---|---|---|---|
| | 1 | 2 | 3 | 4 | 1 | 2 | 3 | 4 |
| unsheared | 652 | 652 | 789 | 772 | stable | stable | stable | stable |
| 2 passes at 37,000 $sec^{-1}$ | 274 | 601 | 377 | 686 | * | stable | ** | stable |

* = 10% aqueous layer
** = 5% aqueous layer + calcite deposit

The shearing caused a significant drop in viscosity, indicating a breakdown of the suspension. Formulations 2 and 4 showed a significantly smaller decrease in viscosity, indicating almost no breakdown of the suspension. The stability data confirmed this.

EXAMPLE 5

Repeating Example 2, but using a hydro-refined natural bentonite (Gel White GP) instead of the Laponite RDS did not produce a stabilizing effect under high shear.

EXAMPLES 6–7

Repeating Examples 1 and 2 but replacing the Laponite in the latter by Macaloid (as hereinbefore described) gave the following results:

| Shearing condition | Viscosity of Example | | Stability of Example | |
|---|---|---|---|---|
| | 6 | 7 | 6 | 7 |
| unsheared | 568 | 902 | stable | stable |
| 2 passes at 40,000 $sec^{-1}$ | 426 | 826 | 15% aqueous layer + calcite deposit | stable |

EXAMPLES 8–10

The formulation of Example 1 was used as a control in a comparison with the same formulations 9 and 10 which also contained 0.005 and 0.15%, respectively, of Laponite RDS. The comparison was carried out as in Examples 1–4, and the following results were obtained:

| | Viscosity (cP @ 20 $sec^{-1}$) | | |
|---|---|---|---|
| Example | 8 | 9 | 10 |
| Hectorite (%) | 0.0 | 0.005 | 0.15 |
| Shearing Condition: | | | |
| Unsheared | 645 | 645 | 671 |
| 2 passes at 80,000 $sec.^{-1}$ | 206 | 645 | 774 |

| | Stability - 2 days at Ambient Temperature | | |
|---|---|---|---|
| Example | 8 | 9 | 10 |
| Hectorite (%) | 0.0 | 0.005 | 0.15 |
| Unsheared | stable | stable | stable |
| 2 passes at 80,000 $sec^{-1}$ | 25% watery layer | stable | stable |

-continued

| | Stability - 2 days at Ambient Temperature | | |
|---|---|---|---|
| Example | 8 | 9 | 10 |
| Hectorite (%) | 0.0 | 0.005 | 0.15 |
| | sedimented calcite | | |

EXAMPLES 11–12

For comparison purposes, one of the suspending agents as described in U.K. Pat. No. 1,471,278 was used in the formulation of Ex. 1. A fumed silica material, Aerosil® 200 ex Degussa was used in Ex. 12, Ex. 11 being the same as Ex. 1. The following results were obtained:

| | Viscosity (cP @ 20 $sec^{-1}$) | |
|---|---|---|
| | Example 11 Control | Example 12 0.2% Aerosil |
| Unsheared | 645 | 774 |
| 2 passes @ 40,000 $sec^{-1}$ | 387 | 568 |

| | Stability | |
|---|---|---|
| Unsheared | stable | stable |
| 2 passes @ 40,000 $sec^{-1}$ | 20% watery layer calcite sediment | 15% watery layer; no calcite sediment |

When repeating Examples 1 and 3 of U.K. Pat. No. 1,471,278, the formulation of Example 1 was unstable, calcite being rapidly deposited. The formulation of Example 3 separated a layer of clear liquid during storage; it was somewhat gel-like in appearance, but thinned on shaking.

We claim:

1. A liquid medium, capable per se of stably suspending under high extensional shear rates non-colloidal undissolved particulate material, comprising an aqueous medium in which is present:

(a) from 0.2 to 70% of non-colloidal undissolved particulate material;

(b) from 0.5 to 20% of anionic detergent material;

(c) from 0.5 to 25% of a water-soluble electrolyte; and (d) from 0.001 to 0.15% of a hectorite clay, all percentages being calculated on the final product.

2. A liquid medium according to claim 1, in which the amount of the hectorite clay ranges from 0.01 to 0.2% by weight.

3. A liquid medium according to claim 1, further comprising from 0.5 to 15% of a nonionic detergent material.

4. A liquid detergent composition, comprising a liquid medium according to claim 1 and non-colloidal, undissolved particulate material stably suspended therein.

5. A liquid detergent composition according to claim 4 comprising:

(a) from 0.5 to 20% by weight of one or more anionic detergents;

(b) from 0.5 to 15% by weight of one or more nonionic detergents;

(c) from 0.5 to 15% by weight of one or more water-soluble electrolytes;

(d) from 0.2 to 70% of one or more types of particulate abrasive materials;

(e) from 0.001 to 0.15% by weight of a hectorite clay; and (f) the balance consisting of an aqueous medium.

6. A composition according to claim 5, comprising:

(a) from 3 to 15% by weight of the anionic detergent;

(b) from 2–12% by weight of the nonionic detergent;

(c) from 0.5 to 10% by weight of the water-soluble electrolyte;

(d) from 5 to 55% by weight of the particulate abrasive material;

(e) from 0.01 to 0.15% by weight of a hectorite clay; and (f) the balance consisting of an aqueous medium.

* * * * *